United States Patent [19]

Weber-Grabau

[11] Patent Number: 4,818,869

[45] Date of Patent: Apr. 4, 1989

[54] METHOD OF ISOLATING A SINGLE MASS OR NARROW RANGE OF MASSES AND/OR ENHANCING THE SENSITIVITY OF AN ION TRAP MASS SPECTROMETER

[75] Inventor: Michael Weber-Grabau, San Jose, Calif.

[73] Assignee: Finnigan Corporation, San Jose, Calif.

[21] Appl. No.: 53,448

[22] Filed: May 22, 1987

[51] Int. Cl.[4] ..... H01J 49/42

[52] U.S. Cl. ..... 250/282; 250/291; 250/292

[58] Field of Search ..... 250/282, 283, 292, 291, 250/290

[56] References Cited

U.S. PATENT DOCUMENTS 3,527,939 8/1968 Dawson et al. ..... 250/292
4,464,570 8/1984 Allemann et al. ..... 250/291
4,540,884 9/1985 Stafford et al. ..... 250/291

OTHER PUBLICATIONS

J. E. Fulford & R. E. March/"A New Mode Of Operation For The Three-Dimensional Quadrupole Ion Store (QUISTOR): The Selective Ion Reactor"/International Journal of Mass Spectrometry and Ion Physica, 26 (1978) 155-162/Printed in The Netherlands.

*Primary Examiner*—Bruce C. Anderson
*Assistant Examiner*—Jack I. Berman
*Attorney, Agent, or Firm*—Flehr, Hohbach, Test, Albritton & Herbert

[57] ABSTRACT

The method of isolating ions of single mass or narrow range of masses in a three-dimensional ion trap comprising ionizing a sample in the trap at a low RF voltage, increasing the RF voltage and applying a DC voltage whereby to eject unwanted ions while isolating ions of said single mass or narrow range of masses.

4 Claims, 5 Drawing Sheets

METHOD OF ISOLATING A SINGLE MASS OR NARROW RANGE OF MASSES AND/OR ENHANCING THE SENSITIVITY OF AN ION TRAP MASS SPECTROMETER

The present invention relates to a method of isolating a single mass or narrow range of masses and/or enhancing the sensitivity of ion trap mass spectrometers.

Ion trap mass spectrometers, or quadrupole ion stores, have been known for many years and described by a number of authors. They are devices in which ions are formed and contained within a physical structure by means of electrostatic fields such as RF, DC or a combination thereof. In general, a quadrupole electric field provides an ion storage region by the use of a hyperbolic electrode structure or a spherical electrode structure which provides an equivalent quadrupole trapping field.

Mass storage is generally achieved by operating the trap electrodes with values of RF voltage V, its frequency f, DC voltage U and device size $r_O$ such that ions having their mass-to-charge ratios within a finite range are stably trapped inside the device. the aforementioned parameters are sometimes referred to as scanning parameters and have a fixed relationship to the mass-to-charge ratios of the trapped ions. For trapped ions, there is a characteristic frequency for each value of mass-to-charge ratio. In one method for detection of the ions, these frequencies can be determined by a frequency tuned circuit which couples to the oscillating motion of the ions within the trap. U.S. Pat. No. 3,527,939 describes a three dimensional quadrupole mass spectrometer and ion gauge in which superimposed variable high frequency and direct current voltages on the electrodes establish electric fields which trap and store ions of a given or selected mass as they are formed by the ionization mass-selective storage mode. In an article entitled "A New Mode of Operation The Three-Dimensional Quadrupole Ion Store (QUISTOR): The Selective Ion Reactor", International Journal of Mass Spectrometry and Ion Physics, 26 (1978) 155–162, there is described operation in a "mass-selective storage mode." An RF voltage and a DC pulse are superimposed during ionization to trap one, or a narrow range of, ionic species.

In the mass-selective storage mode just described, the ionization takes place at a relatively high RF voltage where less ions can be stored and the sensitivity is reduced.

In ion storage mass spectrometers, like the quadrupole ion trap, ion cyclotron, or FTMS systems, ions are created not continuously, but in a pulsed mode, for example by a pulsed electron beam. All ions created in this event are stored and then mass analyzed. There may be some intermediate steps, like a reaction period in which ion-molecule reactions are allowed to proceed, broad-band or selective excitation, or MS/MS experiments.

In all ion storage mass spectrometers, there exists the fundamental limitation of space-charge, i.e. if too many ions are created, space-charge interaction of these ions deteriorates mass resolution and sensitivity. Typically, this limit is reached when approximately $10^5$–$10^6$ ions are stored. This results in a limitation of internal dynamic range: too few ions of a species of low abundance may be present to give a satisfactory signal-to-noise ratio in the mass analysis process. Also, there may not be enough ions to obtain sufficient signal-to-noise ratios in subsequent experiments like MS/MS or ion-molecule reaction studies.

It would be desirable to be able to create ions at a low RF voltage where a larger total member of ions can be stored and then to select the desired mass or range of masses. It would also be desirable to accumulate low abundance ions through repetitive ion formation selection steps.

It is an object of the present invention to provide a method of operating a three-dimensional ion trap with enhanced sensitivity.

It is another object of the present invention to provide a method of operating a three-dimensional ion trap so as to accumulate low abundance ions.

The above and other objects are achieved by creating ions at low RF voltages where the sensitivity (peak height/ionization time) is better and thereafter isolating a single mass or narrow mass range by increasing the RF voltage and applying a DC pulse to move the ions of desired mass to a peak in the stability diagram.

The invention will be more clearly understood from the following description and accompanying drawings.

Figure 1:
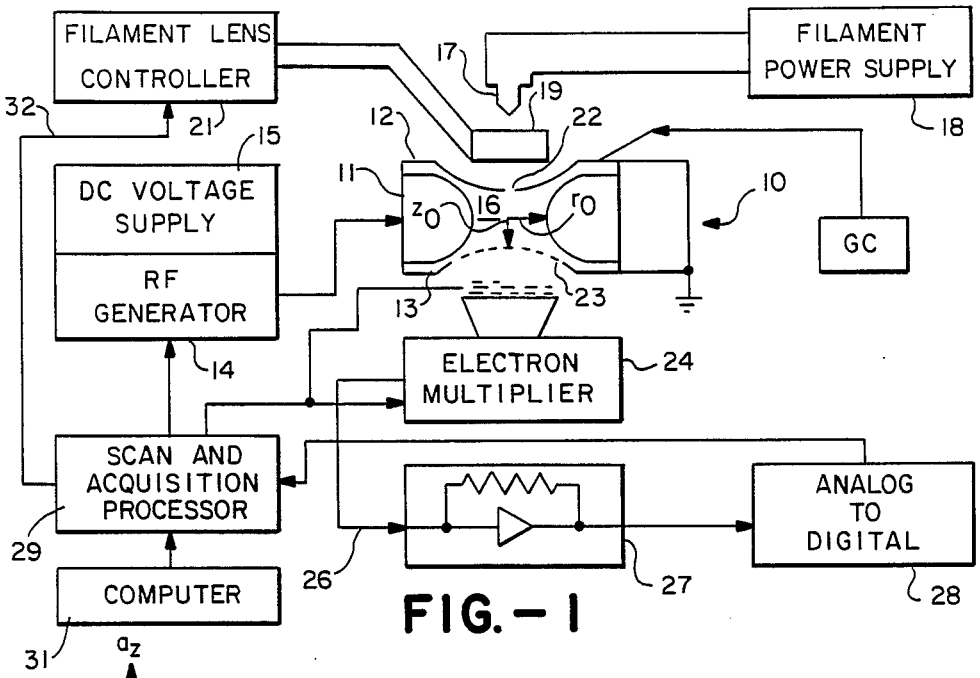
FIG. 1 is a simplified schematic of a quadrupole ion trap along with a block diagram of associated electrical circuits adapted to be used according to the method embodying the present invention.

There is shown in FIG. 1 at 10 a three-dimensional ion trap which includes a ring electrode 11 and two end caps 12 and 13 facing each other. A radio frequency (RF) voltage generator 14 and a DC power supply 15 are connected to the ring electrode 11 to supply a radio frequency voltage V and DC voltage U between the end caps and the ring electrode. These voltages provide the quadrupole field for trapping ions within the ion storage region or volume 16 having a radius $r_0$ and a vertical dimension $a_0$ ($z_0^2 = r_0^2/2$). A filament 17 which is fed by a filament power supply 18 is disposed to provide an ionizing electron beam for ionizing the sample molecules introduced into the ion storage region 16. A cylindrical gate electrode and lens 19 is powered by a filament lens controller 21. The gate electrode provides control to gate the electron beam on and off as desired. End cap 12 includes an aperture through which the electron beam projects. The opposite end cap 13 is perforated 23 to allow unstable ions in the fields of the ion trap to exit and be detected by an electron multiplier 24 which generates an ion signal on line 26. An electrometer 27 converts the signal on line 26 from current to voltage. The signal is summed and stored by the unit 28 and processed in unit 29. Scan and acquisition processor 29 is connected to the RF generator 14 to allow the magnitude and/or frequency of the fundamental RF voltage to be varied for providing mass selection. The controller gates the filament lens controller 21 via line 21 to provide an ionizing electron beam. The scan and acquisition processor is controlled by computer 31.

Figure 2:
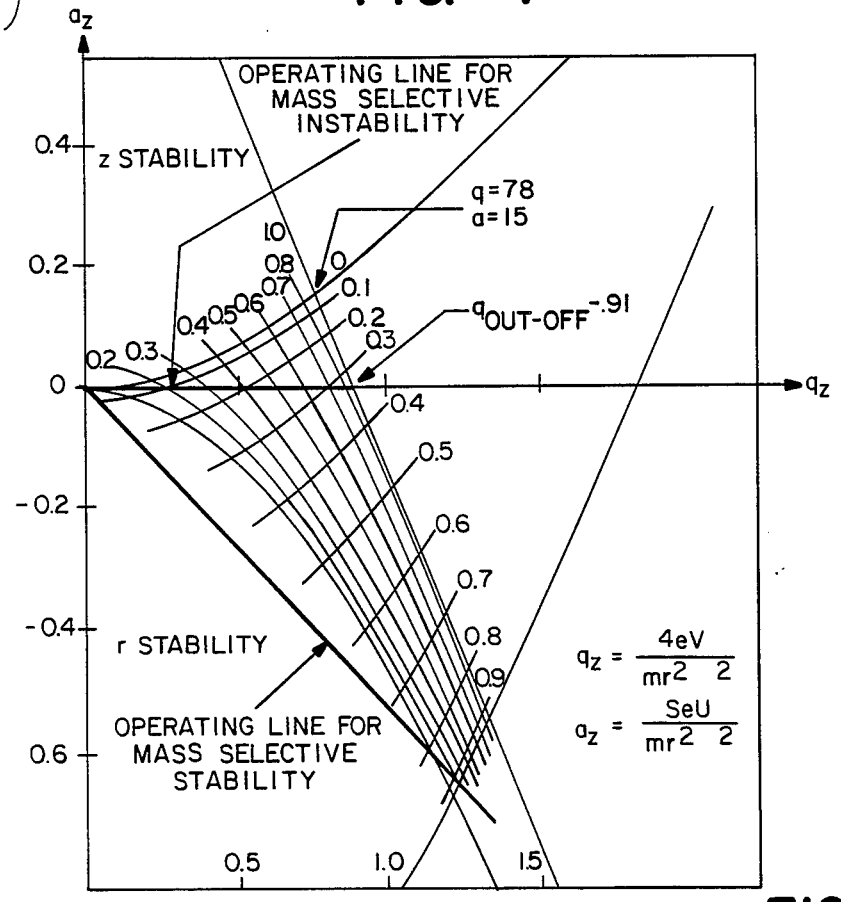
FIG. 2 is a stability envelope for an ion store device of the type shown in FIG. 1.
Figure 3:
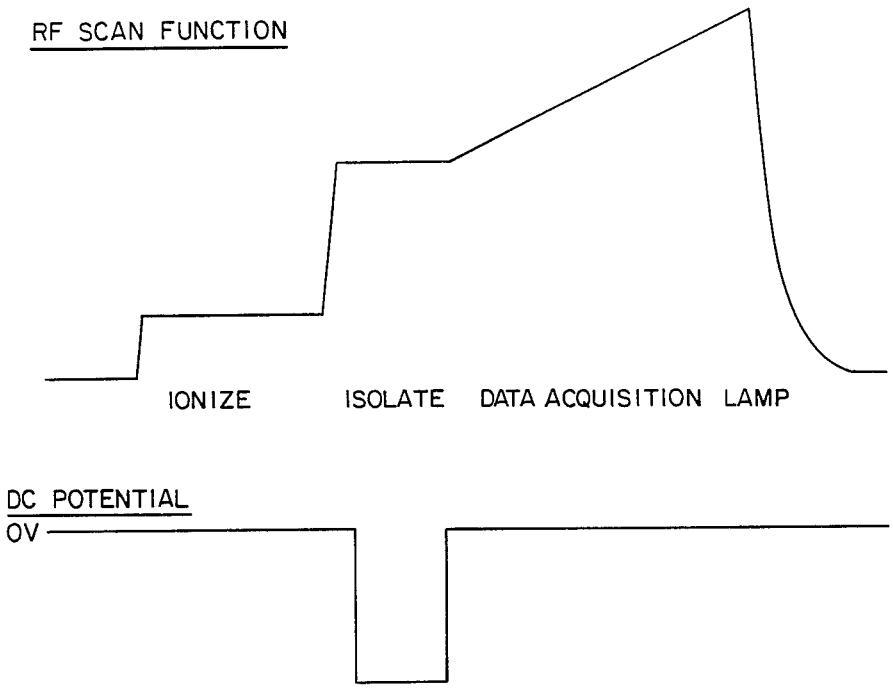
FIG. 3 shows the scanning program for an ion trap mass spectrometer operated in accordance with the present invention.

The symmetric three dimensional fields in the ion trap 10 lead to the well known stability diagram shown in FIG. 2. The parameters a and q in FIG. 2 are defined as:

$$a = -8eU/mr_0^2\omega^2$$

$$q = 4eV/mr_0^2\omega^2$$

where e and m are respectively c particle. For any particular ion, the values of a and q must be within the stability envelope if it is to be trapped within the quadrupole fields of the ion trap device.

The type of trajectory a charged particle has in a described three-dimensional quadrupole field depends on how the specific mass of the particle, m/e, and the applied field parameters, U, V, $r_0$ and $\omega$ combined to map onto the stability diagram. If the scanning parameters combine to map inside the stability envelope then the given particle has a stable trajectory in the defined field. A charged particle having a stable trajectory in a three-dimensional quadrupole field is constrained to an orbit about the center of the field. Such particles can be thought of as trapped by the field. If for a particle m/e, U, V, $r_0$ and $\omega$ combine to map outside the stability envelope on the stability diagram, then the given particle has an unstable trajectory in the defined field. Particles having unstable trajectories in a three-dimensional quadrupole field obtain displacements from the center of the field which approach infinity over time. Such particles can be thought of escaping the field and are consequently considered untrappable.

For a three-dimensional quadrupole field defined by U, V, $r_0$ and $\omega$, the locus of all possible mass-to-charge ratios maps onto the stability diagram as a single straight line running through the origin with a slope equal to $-2U/V$. (This locus is also referred to as the scan line.) That portion of the loci of all possible mass-to-charge ratios that maps within the stability region defined the region of mass-to-charge ratios particles may have if they are to be trapped in the applied field. By properly choosing the magnitude of U and V, the range of specific masses to trappable particles can be selected. I the ratio of U to V is chosen so that the locus of possible specific masses maps through an apex of the stability region (line a of FIG. 2) then only particles within a very narrow range of specific masses will have stable trajectories. However, if the ratio of U to V is chosen so that the locus of possible specific masses maps through the middle of the stability region (line b of FIG. 2) then particles of a broad range of specific masses will have stable trajectories.

According to the present invention, ions of interest are selected by a two step process: ions are created at low RF voltages used in the standard mode of operation such as along the line $q_2$, FIG. 2. The RF voltage is then increased so that the operating point lies below the apex, q=0.78. Thereafter a DC voltage pulse is applied so that a is increased to about 0.15. This will isolate ions of a single mass or a narrow mass range at the apex. All other ions which have been created fall outside the stability envelope.

The ions of single mass are then trapped and can be used for CI scan functions or for MS/MS experiments. The ions can also be ejected by applying a pulse to an end cap and then detected. By repeating these steps with different applied RF and DC voltages, ions of different selected masses can be selected thereby providing a means for mass analysis.

Figure 4:
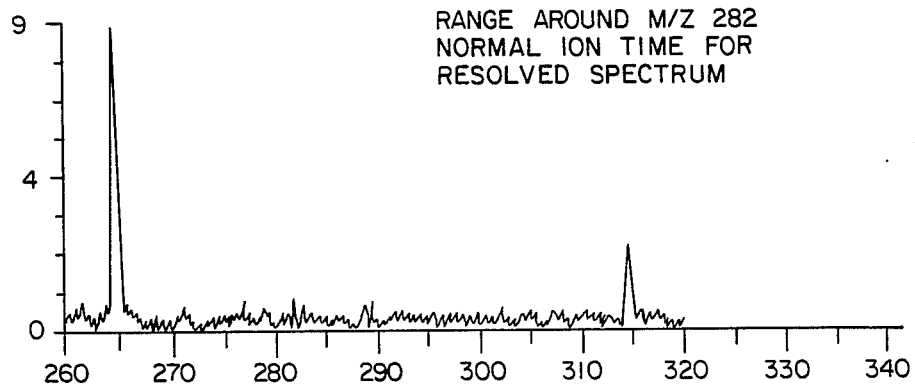
FIGS. 4–9 illustrate the effect of increasing the DC voltage pulse for PFTBA peak at m/z 281.
Figure 5:
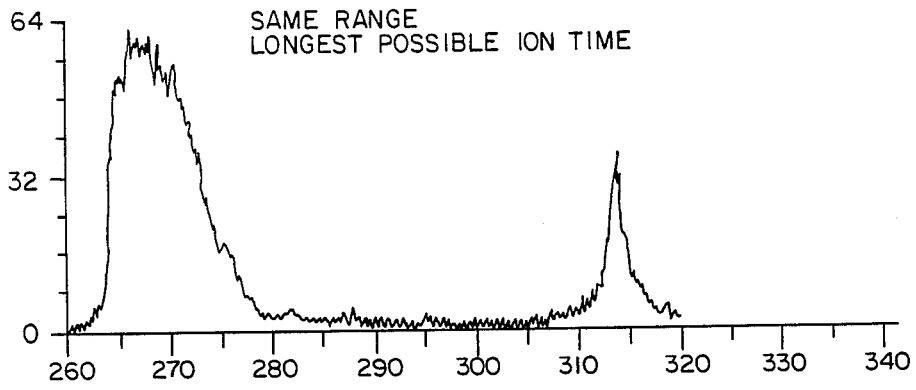
Figure 6:
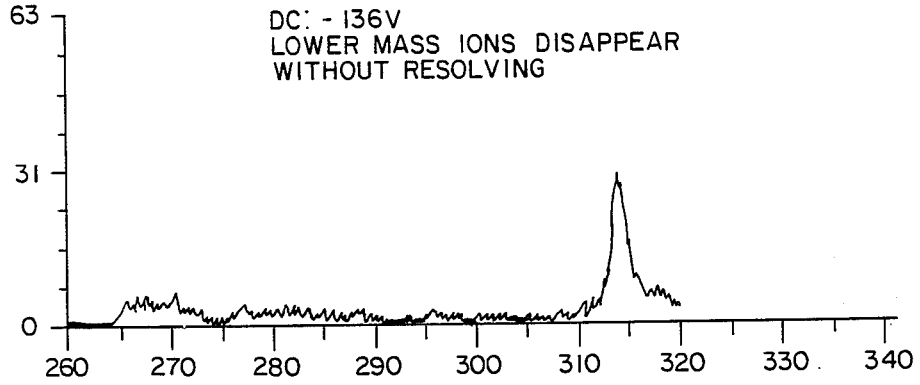
Figure 7:
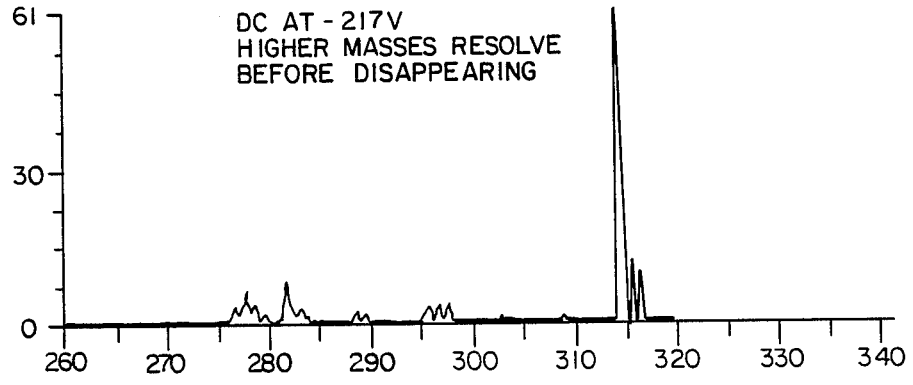
Figure 8:
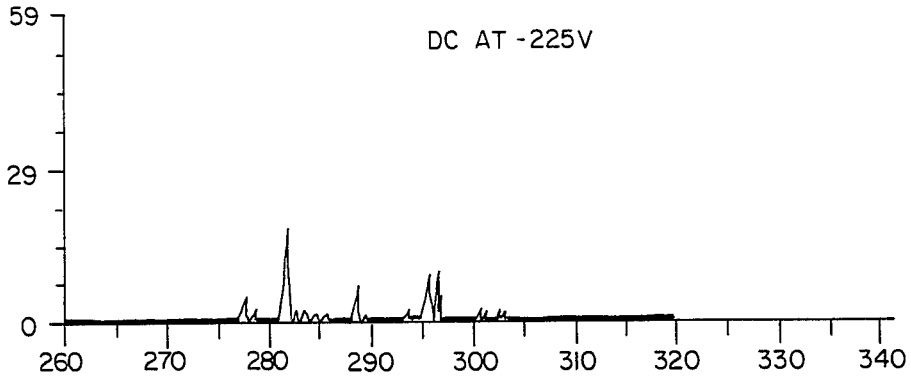
Figure 9:
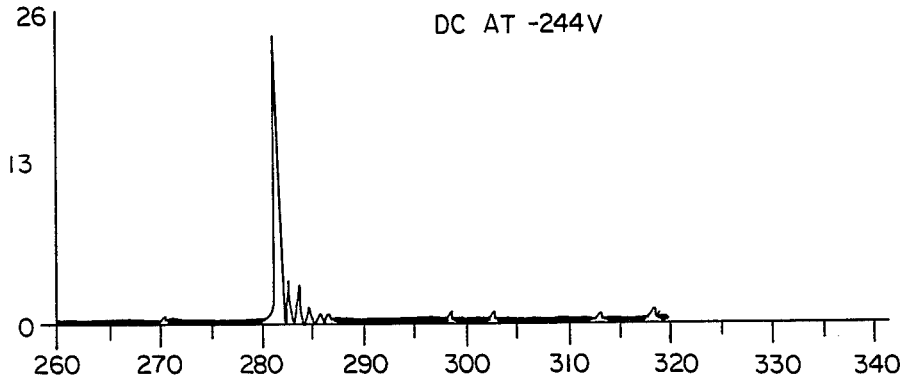

FIGS. 4–9 illustrate the effects of gradually increasing the DC for the PFTBA peak at m/z 281, which is not detected under normal conditions, FIG. 4. Increasing the ionization time leads to a typical space charge situation with complete loss of resolution, FIG. 5. When the DC voltage is gradually increased, the lower mass ions become unstable first (z instability) and are lost, FIG. 6, which is expected because of the asymmetric shape of the stability diagram apex. Then, at higher voltages, the high mass ions disappear, also, but they seem to resolve right before they cross the boundary to r instability, FIGS. 7 and 8. At −225V a variety of resolved peaks can be seen in a window around m/z 281, FIG. 8. Finally, only m/z 281 and its isotope peaks remain stable in the trap and are resolved, FIG. 9.

Figure 10:
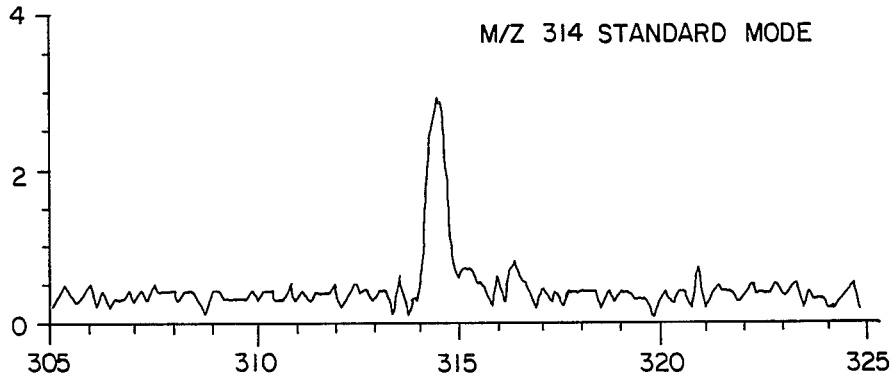
FIGS. 10–12 illustrate the gain sensitivity for the small peak m/z 314.
Figure 11:
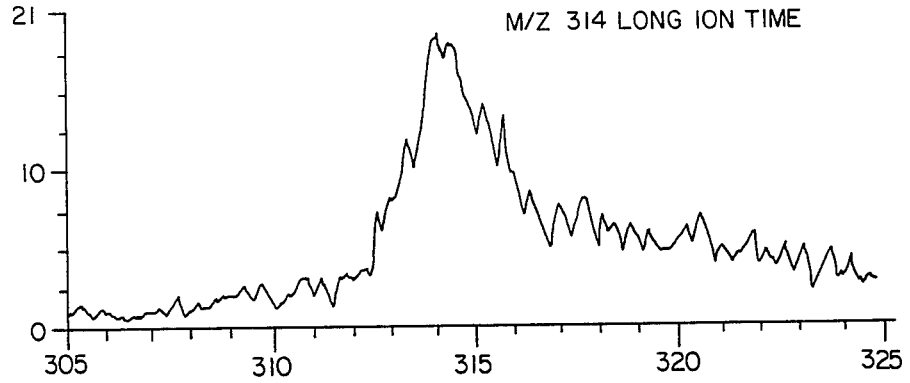
Figure 12:
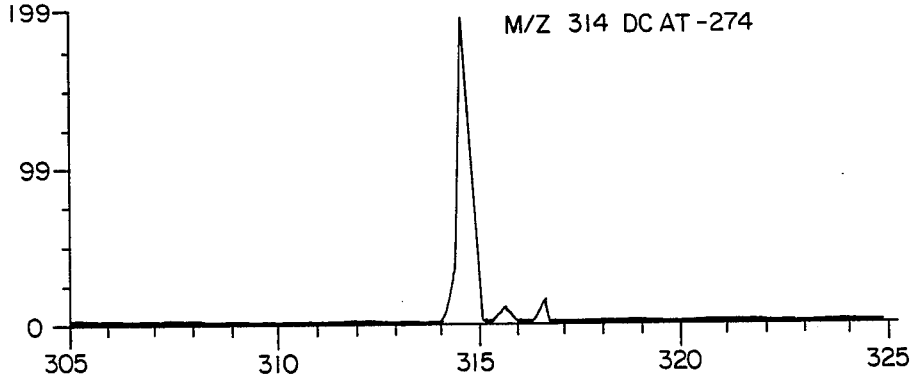

FIGS. 10–12 illustrate the tremendous gain in sensitivity for the small peak at m/z 314; notice the resolution for the isotope peaks, FIG. 12.

As described above, ion storage mass spectrometers have a fundamental space charge limitation. This results in too few ions of a species of low abundance to give a satisfactory signal-to-noise ratio in the mass analysis. Also, there may not be enough ions to carry out subsequent experiments like MS/MS or ion molecule reactions.

Figure 13:
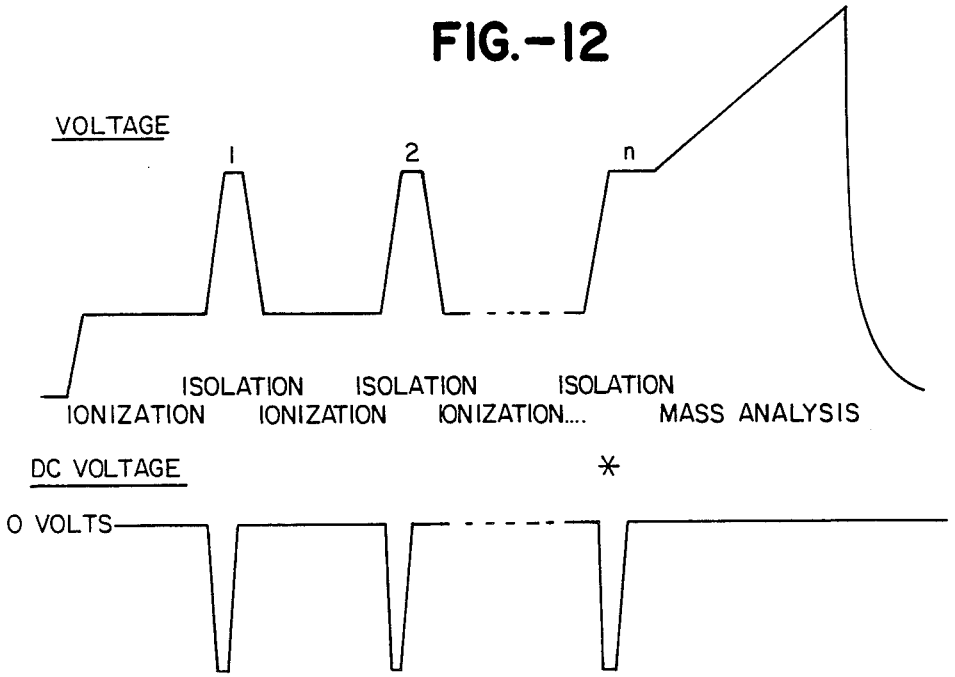
FIG. 13 shows the scanning program for an ion trap mass spectrometer operated in accordance with another embodiment of the invention.

In accordance with another feature of the invention, the process described above; ionization and isolation of ion mass or masses of interest, is repeated until enough ions of interest have been accumulated. This process is illustrated in FIG. 13. Mass analysis or other experiments with the species of interest can then be carried out.

Even though the device may be filled with ions in each ionization step up to or exceeding the limit where space-charge effects would affect performance in the mass analysis step, this problem is overcome by the mass isolation step. With repetitive ionization/mass isolation sequences, ions of a species of low abundance are accumulated until a sufficient number is obtained for mass analysis, MS/MS, or other studies. In principle, this accumulation can go on until the space-charge limit is reached for only the selected ion(s).

We have applied this method in a quadrupole ion trap. Isolation of a mass species was obtained with combined RF and DC potentials. Isolation of masses of interest by means of an auxiliary RF voltage is also possible. This method of using multiple ionization/isolation steps can also be applied to an ion cyclotron or FTMS system; isolation of masses of interest is possible, for example, by Stored Waveform Inverse Fourier Transform (SWIFT) excitation.

I claim:

1. The method of increasing the sensitivity of an ion trap mass spectrometer to ions of selected mass or masses comprising the steps of generating an RF field, introducing a sample into the RF field, ionizing the sample to form ions which are trapped in the RF field, increasing the RF field to eject ions having masses less than the selected mass or masses and thereafter applying a pulsed DC field to eject ions of unwanted mass above and below said selected mass or masses while trapping ions of said selected mass or masses.

2. The method as in claim 1 in which the selected ions are mass analyzed by thereafter changing said RF field to selectively and sequentially eject said trapped ions.

3. The method as in claim 1 whereas the steps of ionization and selection are repeated to accumulate ions of selected mass or masses.

4. The method in which a mass spectrum is generated by repeating the method in claim 1 for one mass at a time.

* * * * *